US006694694B2

(12) United States Patent
Zeeff

(10) Patent No.: US 6,694,694 B2
(45) Date of Patent: Feb. 24, 2004

(54) EXTERIOR PANEL

(76) Inventor: Bradley J. Zeeff, 9449 Grand Ridge Dr., Zeeland, MI (US) 49464

( * ) Notice: Subject to any disclaimer, the term of this patent is extended or adjusted under 35 U.S.C. 154(b) by 109 days.

(21) Appl. No.: 09/964,197

(22) Filed: Sep. 26, 2001

(65) Prior Publication Data

US 2003/0056457 A1 Mar. 27, 2003

(51) Int. Cl.[7] ..... E04B 2/00; E04B 2/32

(52) U.S. Cl. ..... 52/506.01; 52/506.06; 52/506.08; 52/508; 52/510

(58) Field of Search ..... 52/506.06, 506.08, 52/506.01, 508, 510, 483.1, 235, 243, 511, 733.4, 475.1, 482, 506.04, 506.09, 509, 546, 551, 552, 553, 506.03, 506.05, 518–520

(56) References Cited

U.S. PATENT DOCUMENTS 3,218,772 A * 11/1965 Martin ..... 52/508
5,191,745 A * 3/1993 Story ..... 52/506.05
5,544,461 A * 8/1996 Sommerstein ..... 52/235
5,636,489 A 6/1997 Leverrier et al.
6,289,647 B1 * 9/2001 Sjolander ..... 52/510
6,347,495 B1 * 2/2002 Conterno ..... 52/483.1
6,421,974 B1 * 7/2002 Whitehouse et al. ..... 52/510
6,425,218 B1 * 7/2002 Doyon et al. ..... 52/235

* cited by examiner

*Primary Examiner*—Jeanette Chapman
(74) *Attorney, Agent, or Firm*—Price, Heneveld, Cooper, DeWitt & Litton

(57) ABSTRACT

An aluminum wall panel comprising a plate, a top flange extending from a top of the plate, a bottom flange extending from a bottom of the plate, a first side flange extending from a first side of the plate and a second side flange extending from a second side of the plate. The panel includes a first projection and a second projection extending from the top flange and defining a channel therebetween. The panel also includes a third resilient projection extending from the bottom flange. The third resilient projection presses against a matching projection of the second wall panel to rigidly connect the wall panel to the second wall panel when the wall panel and the second wall panel are fixed to a supporting framework. The first side flange and the second side flange taper upwards to allow the plate to be parallel with the second wall panel.

38 Claims, 6 Drawing Sheets

EXTERIOR PANEL

BACKGROUND OF THE INVENTION

The present invention relates to a building, and in particular to an exterior or interior wall of a building.

Exterior walls of buildings protect the outside of the building from the elements and prevents rain and other precipitation from entering the building. The exterior walls of buildings also provide insulation from the temperatures of the outside air. Furthermore, exterior walls of a building can provide an aesthetically pleasing appearance.

Heretofore, exterior walls of buildings have been designed using panels that are located about an exterior facing of the buildings and are typically sealed to the exterior facing and to each other using a sealant or gaskets. However, the sealant and gaskets can sometimes fail, thereby reducing the efficiency of the wall panels. Furthermore, adding the sealant and gaskets can be very time consuming, thereby adding expensive labor costs to the construction of the buildings. One attempt to a solution to the above problems is disclosed in U.S. Pat. No. 5,636,489 to Leverrier et al. The wall panels as disclosed by Leverrier et al. include a groove along the top of the panels for accepting a flange extending from the bottom of a panel positioned thereabove. The wall panels are connected to the exterior facing by placing fasteners only through the top of the wall panels. However, the wall panels as disclosed by Leverrier et al. are made of polyester, which sometimes does not have a long lifespan when exposed to harsh environments. Additionally, the wall panels as disclosed by Leverrier et al. can sometimes be loosely connected to adjacent wall panels at the bottom of the wall panels because the movement of the flange extending from the bottom of the wall panel in its associated groove. Furthermore, since a portion of the wall panels extend over a portion of the wall panels placed therebelow, the wall panels are sometimes not all located on a single plane, thereby providing an aesthetically displeasing appearance.

Accordingly, wall panels solving the aforementioned disadvantages and having the aforementioned advantages is desired.

SUMMARY OF THE INVENTION

The wall panels of the present invention can easily be connected to a supporting structure without sealants or gaskets. In a first aspect of the present invention, the wall panels include a resilient projection pressing against a matching projection of a second wall panel to rigidly connect the wall panel to the second wall panel when the wall panel and the second wall panel are fixed to a supporting framework. In a second aspect of the present invention, wall panels include a pair of side flanges that taper upward to allow each of the wall panels to be parallel with other wall panels. In a third aspect of the present invention, the wall panel is made from one of aluminum, stainless steel, zinc or copper.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
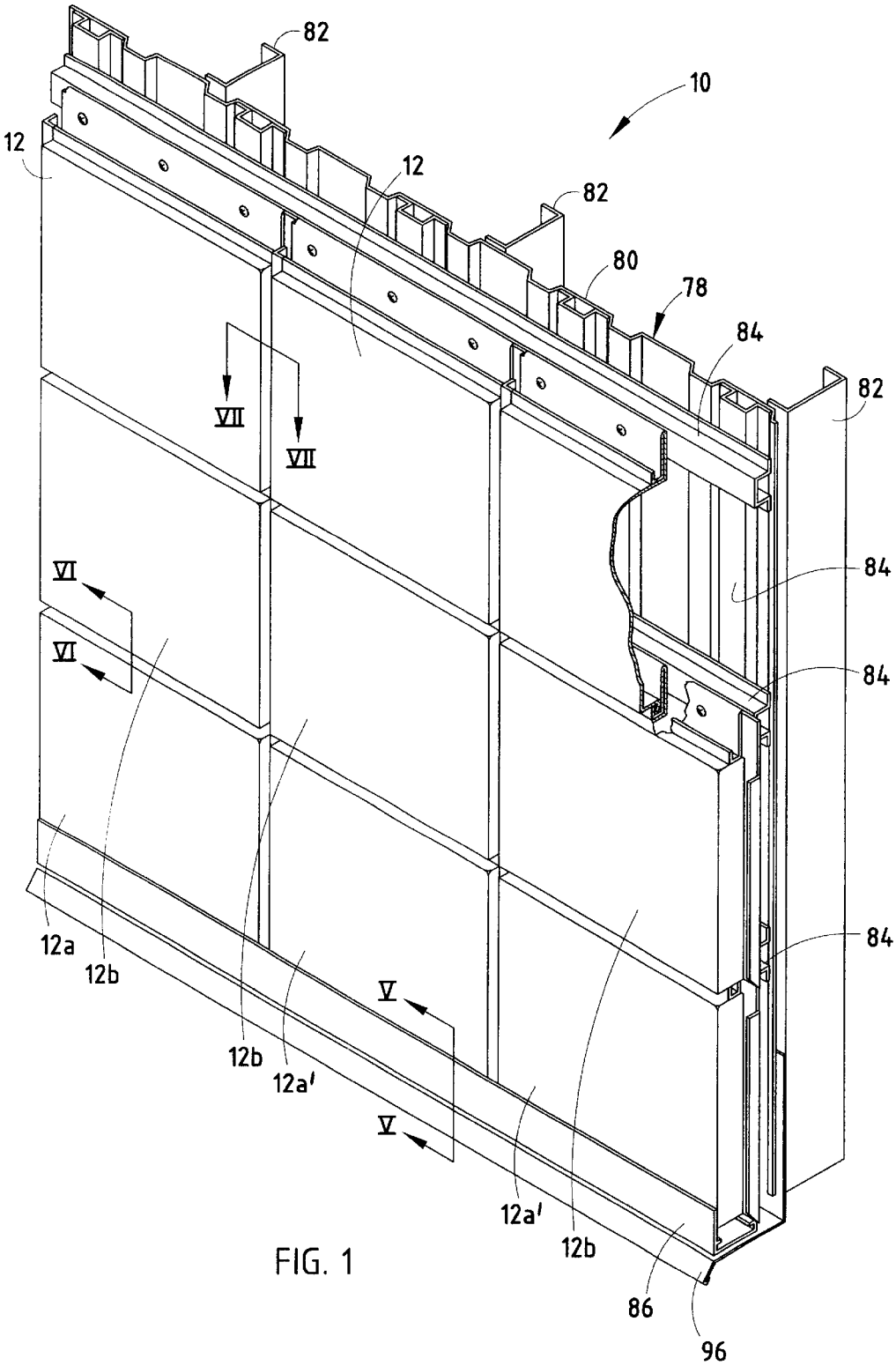
FIG. 1 is a perspective view of a wall of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a wall embodying the present invention. In the illustrated example, the wall 10 includes a plurality of identical wall panels 12. The wall panels 12 are preferably located on the exterior or interior of a building for protecting the building against the elements and for providing the exterior of the building with a decorative design. Each wall panel 12 is preferably made from a sheet of folded aluminum, stainless steel, zinc or copper to form an integral panel 12.

Figure 2:
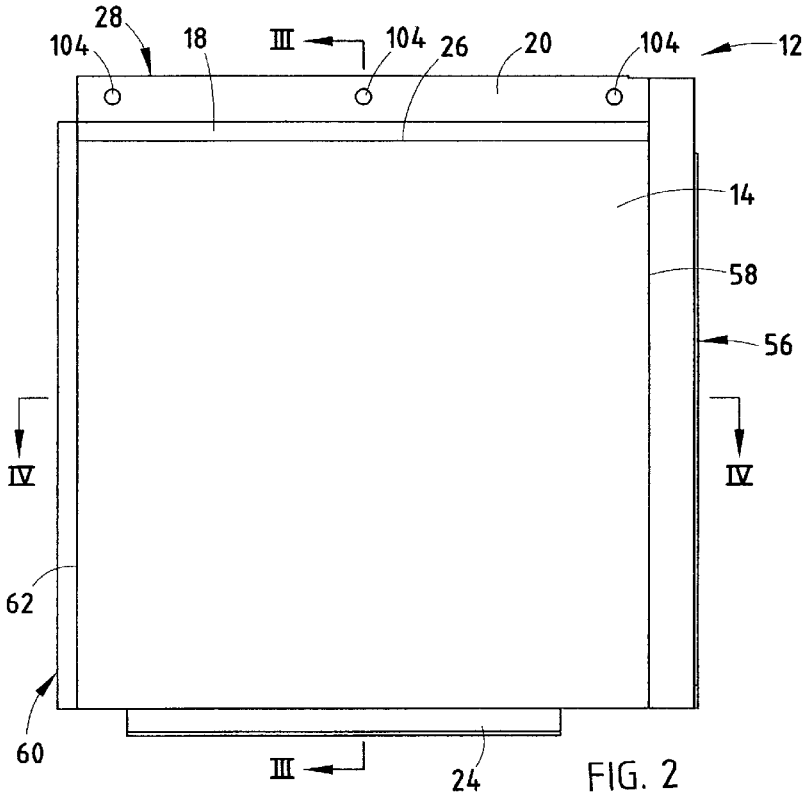
FIG. 2 is a front view of a wall panel of the present invention.
Figure 3:
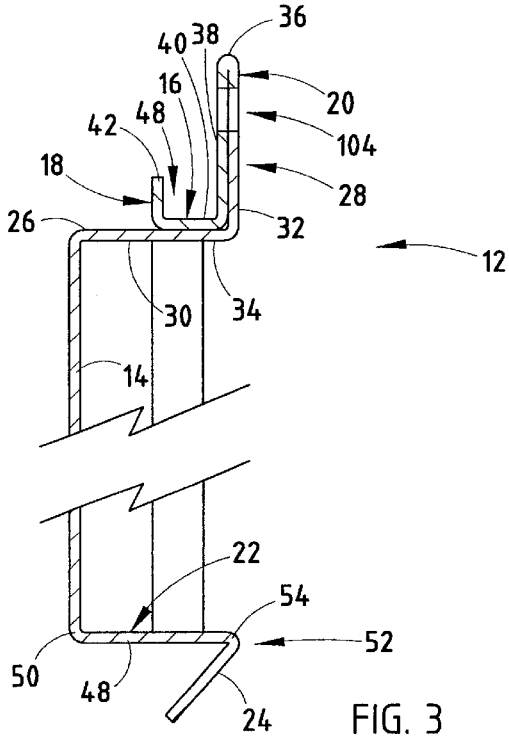
FIG. 3 is a cross-sectional view of the wall panel of the present invention taken along the line III—III of FIG. 2.
Figure 4:
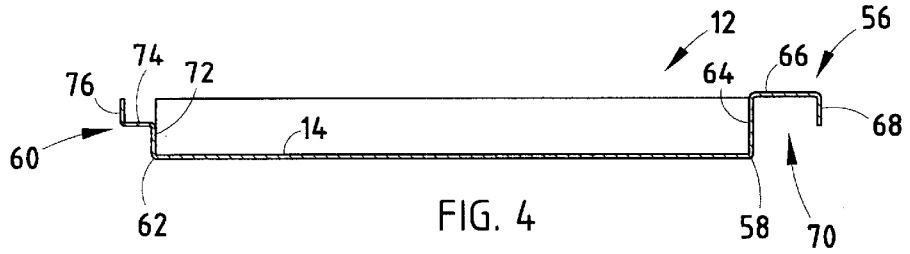
FIG. 4 is a cross-sectional view of the wall panel of the present invention taken along the line IV—IV of FIG. 2.

The illustrated wall panels 12 (FIGS. 2–4) each include a substantially rectangular plate 14, a top flange 16, a first projection 18 and a second projection 20 extending from the top flange 16, a bottom flange 22 and a third resilient projection 24 extending from the bottom flange 22. The top flange 16 and the bottom flange 20 are used to connect a pair of vertically adjacent wall panels 12. The top flange 16, first projection 18 and the second projection 20 extend rearwardly from a top 26 of the plate 14 and are preferably an integral section 28 folded several times to form the finished configuration for the top flange 16, first projection 18 and the second projection 20. The integral section 28 includes a first top horizontal sheet 30 extending rearward from the top 26 of the plate 14. The integral section 28 also includes a first top vertical sheet 32 extending upward from an end 34 of the first top horizontal sheet 30, with the first top vertical sheet 32 being folded over at a top fold point 36 to form a second top vertical sheet 38 overlapping the first top vertical sheet 32. The integral section 28 further includes a second top horizontal sheet 40 extending forward from an end of the second top vertical sheet 38 and overlapping the first top horizontal sheet 30. Finally, a third top vertical sheet 42 extends upward from an end of the second top horizontal sheet 40. The third top vertical sheet 42 forms the first projection 18 and the first top vertical sheet 32 and the second top vertical sheet 38 form a second projection 20. A channel 48 is thereby formed between the first projection 18 and the second projection 20. The bottom flange 22 extends rearwardly from a bottom 50 of the plate 14 and the third resilient flange 24 extends downwardly and forwardly from the rear edge of flange 22, at an acute angle to the flange 22. Like the top flange 16, flanges 22 and 24 are preferably formed from an integral section 52 folded to form the finished configuration for the bottom flange 20 and the third resilient flange 24. The integral section 52 of the wall panel 12 includes a bottom horizontal sheet 48 extending rearwardly from the bottom 50 of the plate 14 and the third resilient projection 24 extending forwardly and downwardly from an end 54 of the bottom horizontal sheet 48. As described in more detail below, the third resilient projection 24 is configured to be placed within the channel 48 of a second wall panel 12 positioned below the wall panel 12 for connecting the pair of vertically adjacent wall panels 12.

In the illustrated example, the wall panel 12 also includes a first side flange 56 extending rearwardly from a first side 58 of the plate 14 and a second side flange 60 extending rearwardly from a second side 62 of the plate 14. The first side flange 56 includes a first side first sheet 64 extending rearwardly from the first side 58 of the plate 14, a first side second sheet 66 extending outwardly from an end of the first side first sheet 64 and a first side third sheet 68 extending forwardly from an end of the first side second sheet 66. A slot 70 is thereby formed between the first side first sheet 64 and the first side third sheet 68. The second side flange 60 includes a second side first sheet 72 extending rearwardly from the second side 62 of the plate 14, a second side second sheet 74 extending outwardly from an end of the second side first sheet 72 and a second side third sheet 76 extending rearwardly from an end of the second side second sheet 74. As described in more detail below, the second side third sheet 76 is configured to be placed within the slot 70 of a third wall panel 12 positioned adjacent the second side 62 the wall panel 12 for connecting the pair of horizontally adjacent wall panels 12.

The illustrated wall panels 12 are used to form the wall 10 by first providing a supporting framework 78 on the building (FIG. 1). The supporting framework 78 is any framework that can accept fasteners therein and can support the wall panels 12. In FIG. 1, the supporting framework 78 is shown as being a metal panel substrate 80 configured to be attached to metal studs 82 of a building and a plurality of horizontally and vertically aligned U-shaped beams 84 connected to the metal panel substrate 80. Although the metal panel substrate 80 and the U-shaped beams 84 are shown as forming the supporting framework 78, the supporting framework can be any support that will support the wall panels 12. For example, the supporting framework 78 could be concrete, wood or any other configured framework.

Figure 5:
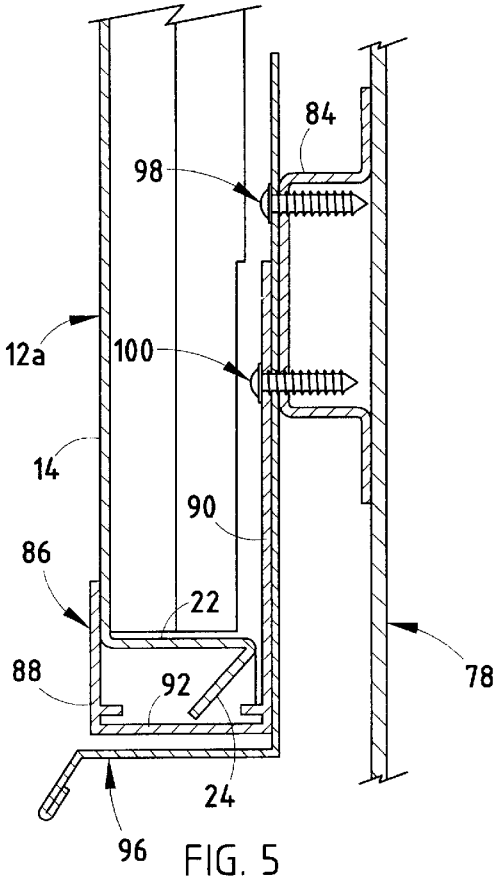
FIG. 5 is a cross-sectional view of the bottom of the wall of the present invention.

Before the wall panels 12 are connected to the supporting framework 78, a bottom retaining member 86 is preferably located along the bottom of the supporting framework 78. The illustrated bottom retaining member 86 (FIGS. 1 and 5) is a U-shaped sill having a first leg 88, a second leg 90 and a cross leg 92. The first leg 88, the second leg 90 and the cross leg 92 define a recess 94 for receiving the bottom flange 22, the third resilient projection 24 and a bottom portion of the plate 14 of the panel 12. The bottom retaining member 86 is connected to the supporting framework 78 by first connecting a weather drip 96 along a bottom of the supporting framework 78 with a first fastener 98. The second leg 90 of the bottom retaining member 86 is thereafter also connected to the bottom of the supporting framework 78 with a second fastener 100. The bottom of the panel 12 is then placed within the recess 94 of the bottom retaining member 86, thereby retaining and covering the bottom flange 22, the third resilient projection 24 and a bottom portion of the plate 14 of the panel 12. Although the bottom retaining member 86 is described as retaining the bottom of the panel 12, it is contemplated that other means of retaining the bottom of the panel 12 can be used.

The wall panels 12 are connected to the structural framework 78 to form the wall 10 (FIG. 1) by first placing the bottom of the bottommost and leftmost wall panel 12A into the bottom retaining member 86. Third fasteners 102 (see FIG. 6) are then placed through apertures 104 in the first top vertical sheet 32 and the second top vertical sheet 38 of the second projection 20 of the panel 12 and into the U-shaped beams 84 of the structural framework 78. The remaining wall panels 12A' of the bottom row of the wall 10 are then placed into position one-by-one and moving towards the right by inserting the bottom of the wall panel 12A' into the bottom retaining member 86 as described above and by placing the second side third sheet 76 of the second side flange 60 into the slot 70 of the first side flange 56 of the wall panel 12A' adjacent on the left (see FIG. 7). Third fasteners 102 are placed through the apertures 104 in each of the walls panels 12A' to connect the wall panels 12A' to the supporting framework 78.

Figure 6:
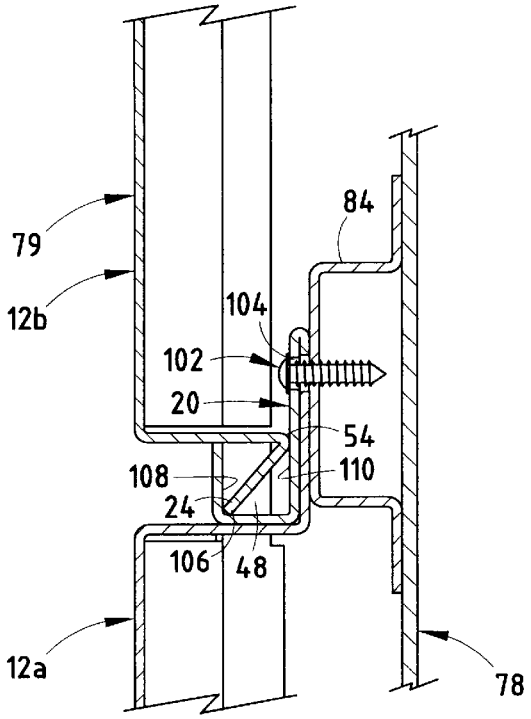
FIG. 6 is a cross-sectional view of the wall of the present invention taken along the line VI—VI of FIG. 1.
Figure 7:
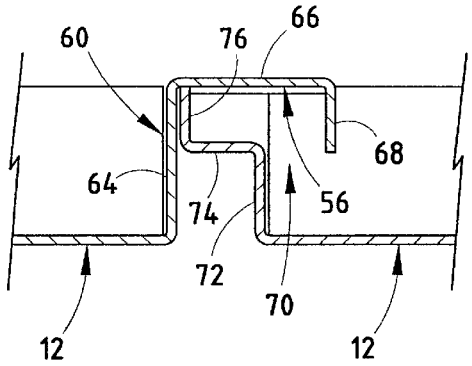
FIG. 7 is a cross-sectional view of the wall of the present invention taken along the line VII—VII of FIG. 1.

After the bottom row of wall panels 12A' are connected to the supporting framework 78, a second bottommost row of wall panels 12B are connected to the supporting framework 78. As seen in FIG. 6, the leftmost wall panel 12B is connected to the wall panel 12A in the bottom row of wall panels 12A by inserting the third resilient flange 24 of the leftmost wall panel 12B into the channel 48 of the wall panel 12A. The wall panel 12B is moved into position by first inserting the third resilient flange 24 into the channel 48 with a top of the wall panel 12B away from the supporting framework 78. The top of the wall panel 12B is then rotated towards the supporting framework 78 along arrow 79. In the illustrated embodiment, the third resilient flange 24 has a horizontal length greater than the distance between the first projection 18 and the second projection 20. Therefore, a front edge 106 of the third resilient flange 24 will press against the inside face 108 of the first projection 18 as the wall panel 12B is rotated into position. Additionally, the end 54 of the bottom horizontal sheet 48 of the bottom flange 22 will press against the inside face 110 of the second projection 20. As the wall panel 12B is rotated into position, the third resilient flange 24 will create a moment on the wall panel 12B forcing the top of the wall panel 12B away from the supporting framework 78. Consequently, when third fasteners 102 are placed through the apertures 104 in the wall panel 12B, the top of the wall panel 12B will be rigidly connected to the supporting framework 78 and the bottom of the wall panel 12B will be pressed against the inside face 108 of the first projection of the wall panel 12A, thereby maintaining the wall panel 12B in position.

The remaining wall panels 12B' in the second row of wall panels 12B' are then placed into position one-by-one and moving towards the right by inserting the third resilient flange 24 of the wall panel 12B' into the channel 48 of the wall panel 12A' as described above and by placing the second side third sheet 76 of the second side flange 60 into the slot 70 of the first side flange 56 of the wall panel 12A' adjacent on the left. Third fasteners 102 are placed through the apertures 104 in each of the wall panels 12B' to connect the wall panels 12B' to the supporting framework 78. Each successive row of wall panels 12 are thereafter placed into position by moving upward to form each vertical row and by moving to the right to position each wall panel 12 into position in the vertical row.

Figure 2A:
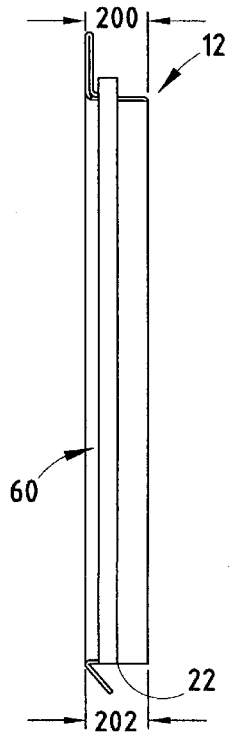
FIG. 2A is a left side view of the wall panel of the present invention.
Figure 2B:
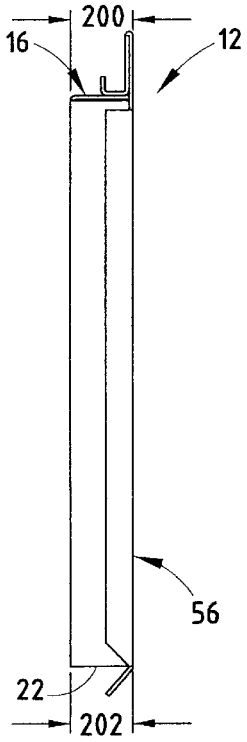
FIG. 2B is a right side view of the wall panel of the present invention.

In the illustrated example, the bottom portion of each of the wall panels 12 is positioned further away from the supporting framework 78 than the top portion of the wall panels 12 because the bottom portion of the wall panels 12 overlaps a portion of the walls panels 12 (or the bottom retaining member 86). Therefore, as seen in FIGS. 2A and 2B, a top width 200 of the first side flange 56 and the second side flange 60 adjacent the top flange 16 is larger than a bottom width 202 of the first side flange 56 and the second side flange 60 adjacent the bottom flange 22. The first side flange 56 and the second side flange 60 preferably taper from the width of the top flange 16 to a width equal to the width of the top flange 16 minus the width of the second projection 20. Therefore, the plate 14 of each wall panel 12 will be vertically positioned and aligned with the other wall panels 12 of the wall 10 when the wall panels 12 are placed into position.

Figure 8:
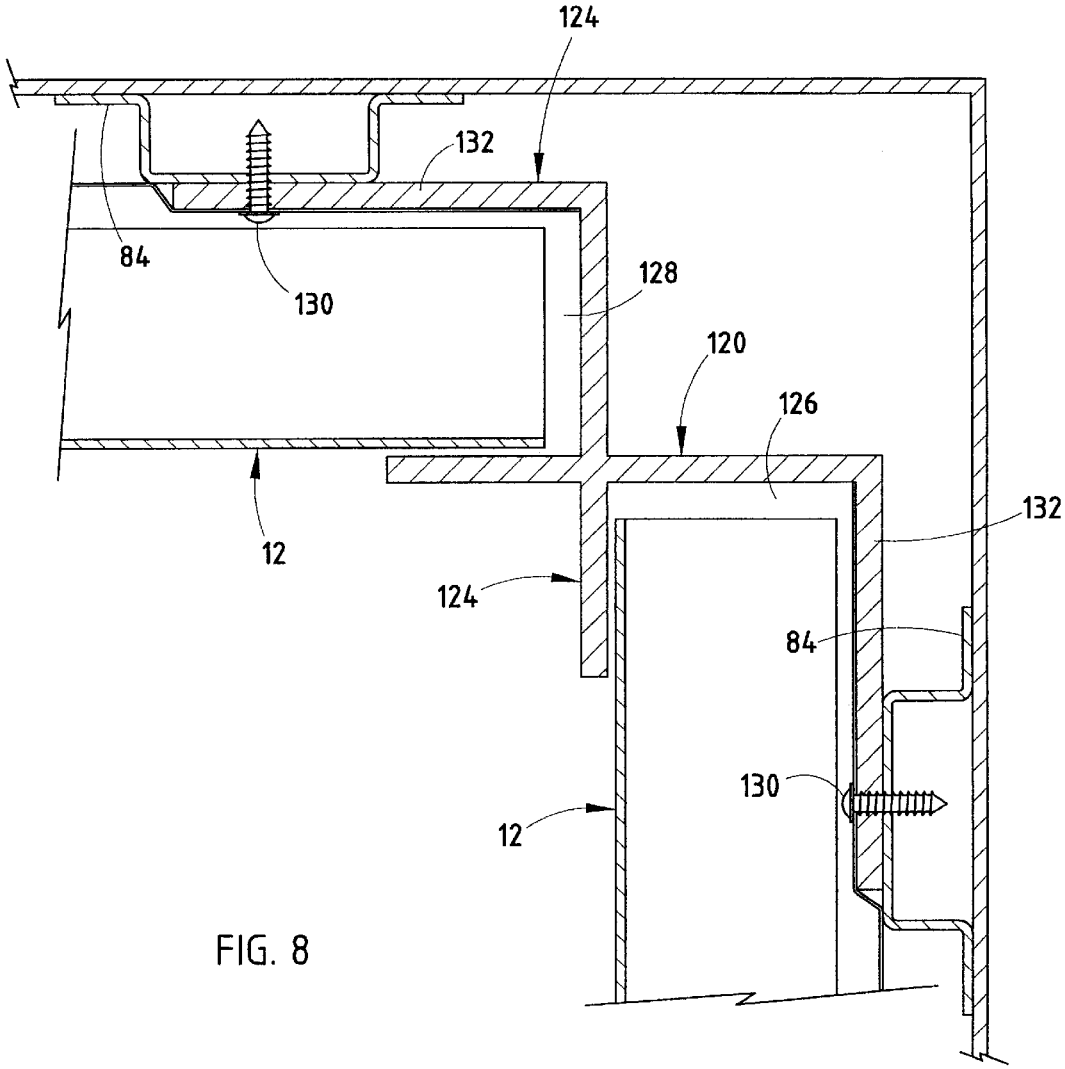
FIG. 8 is a cross-sectional view of an inside corner of the wall of the present invention.
Figure 9:
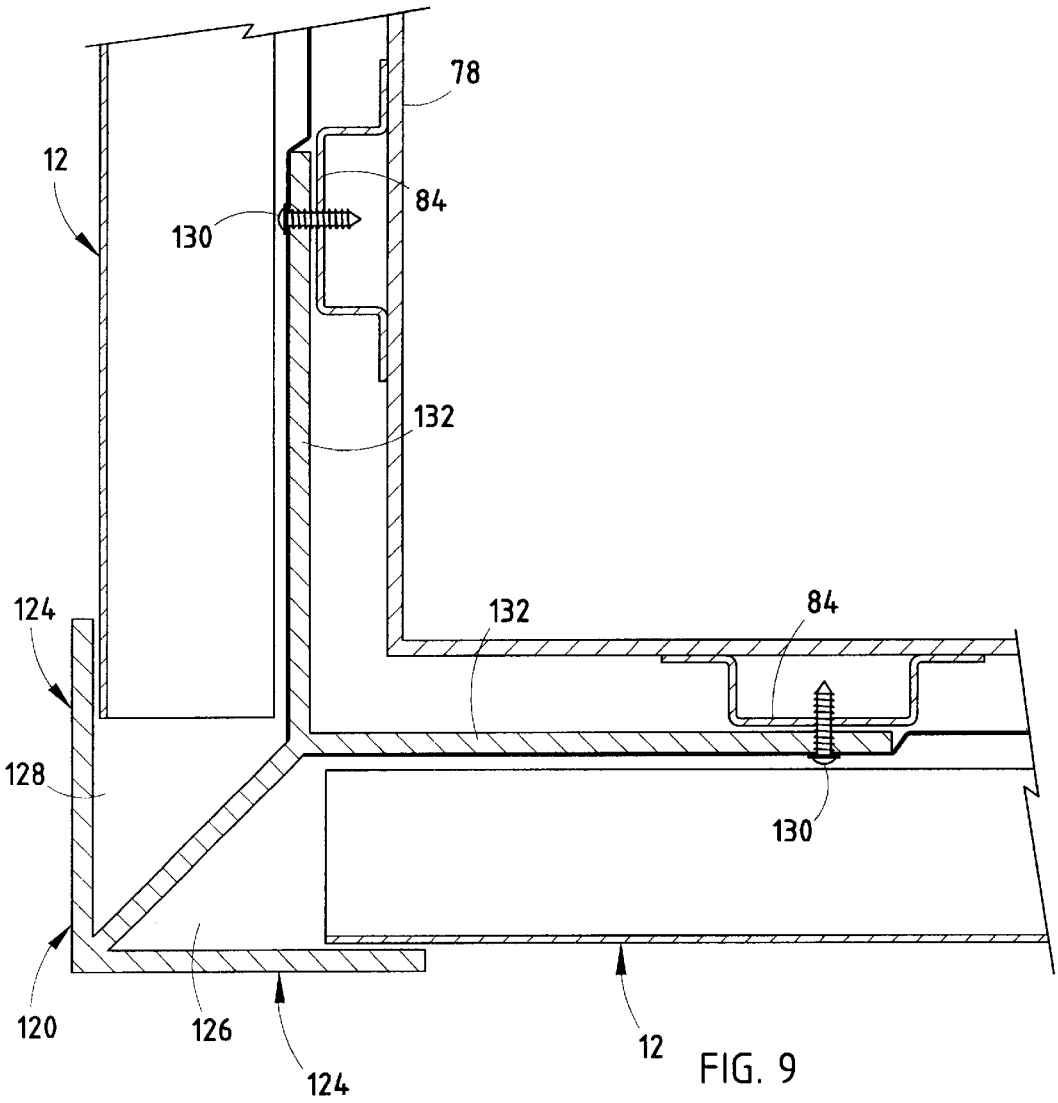
FIG. 9 is a cross-sectional view of an outside corner of the wall of the present invention.
Figure 10:
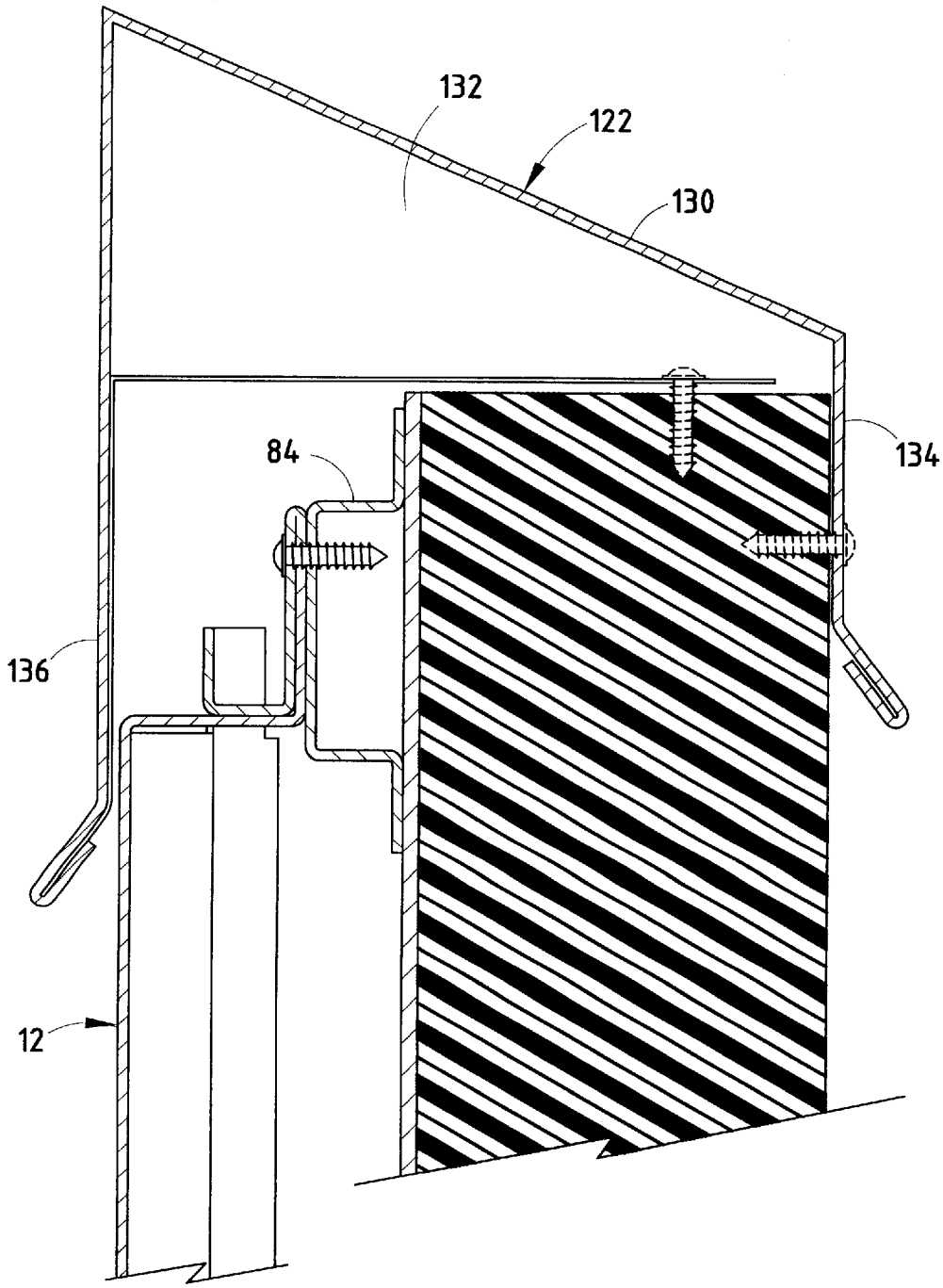
FIG. 10 is a cross-sectional view of a top of the wall of the present invention.

In addition to the bottom retaining member 86, the illustrated wall 10 can include an inside corner retaining member 120 (FIG. 8) and an outside corner retaining member 121 (FIG. 9) for retaining sides of the wall panels 12 at corners of buildings and a top retaining member 122 (FIG. 10) for covering the top of the wall panels 12 at the top of the walls 10. The inside corner retaining member 120 includes a pair of substantially U-shaped members 124 forming a first corner recess 126 and a second recess 128. In the illustrated example, the first corner recess 126 and the second corner recess 128 are perpendicular. However, the first corner recess 126 and the second corner recess 128 can be at any angle, depending on the angle of the corner. The substantially U-shaped members 124 of the inside corner retaining member 120 includes an outwardly facing leg 140 and an inwardly facing leg 142. The inwardly facing leg 142 is longer than the outwardly facing leg 140 and is adjacent the supporting framework 78. The substantially U-shaped members 124 of the inside corner retaining member 120 are connected to each other at a junction point 144 between the outwardly facing leg 140 and a cross leg 146 between the inwardly facing leg 140 and the outwardly facing leg 142. The inside corner retaining member 120 is connected to the supporting framework 78 by inserting fourth fasteners 130 through openings in the inwardly facing legs 140 of each of the substantially U-shaped members 124. The outside corner retaining member 121 also includes a pair of substantially U-shaped members 124 forming a first corner recess 126 and a second recess 128. In the illustrated example, the first corner recess 126 and the second corner recess 128 are perpendicular. However, the first corner recess 126 and the second corner recess 128 can be at any angle, depending on the angle of the corner. The outside corner retaining member 121 includes a pair of substantially U-shaped members 125 forming a first corner recess 127 and a second recess 129. The inwardly facing leg 150 is longer than the outwardly facing leg 150 and is adjacent the supporting framework 78. The substantially U-shaped members 125 of the outside corner retaining member 121 include a single cross leg 156 connected to each inwardly facing leg 150 and outwardly facing leg 152 of both of the substantially U-shaped members 125. The outside corner retaining member 121 is connected to the supporting framework 78 by inserting fourth fasteners 130 through openings in the inwardly facing legs 150 of each of the substantially U-shaped members 125. In the illustrated example, the first corner recess 127 and the second corner recess 129 are perpendicular. However, the first corner recess 127 and the second corner recess 129 can be at any angle, depending on the angle of the corner.

The illustrated wall 10 can also include a top retaining member 122 (FIG. 10) for covering the top of the wall panels 12 at the top of the walls 10. The top retaining member 122 is similar to the bottom retaining member 86 and includes a substantially U-shaped member 130 defining a top recess 132. The top retaining member 122 includes a first leg 134 connected to a rear of the structural framework 78 and a second leg 136 that covers the top of the wall panel 12, with the top of the wall panel 12 being located within the top recess 132. It is further contemplated that other retaining members can be used to retain the top, the bottom or the sides of the wall panels.

The wall 10 therefore includes wall panels that overlap and interlock together to form a pressure equalized rain screen for the building. The wall panels 12 can be installed in any weather without special equipment or temperature requirements and are made from long lasting aluminum. With only 3 fasteners 102 per wall panel 12, the wall panels 12 can be installed quickly. Furthermore, with no joint sealants or gaskets all of the joints of the wall panels 12 remain dry.

It will be readily appreciated by those skilled in the art that modifications may be made to the invention without departing from the concepts disclosed herein. For example, although the wall 10 is easily constructed without sealants or gaskets, it is contemplated that sealants and gaskets can be used during the building of wall 10. Such modifications are to be considered as included in the following claims, unless these claims by their language expressly state otherwise.

What is claimed is:

1. A wall panel comprising:

a substantially rectangular plate;

a top flange extending rearwardly from a top of the plate;

a first projection and a second projection extending upwardly from the top flange, the first projection and the second projection defining a channel therebetween;

a bottom flange extending rearwardly from a bottom of the plate; and a third resilient projection extending downwardly and forwardly from the bottom flange, the third resilient projection and the bottom flange defining an acute angle therebetween;

wherein the third resilient projection is adapted to be inserted into a corresponding channel of a second wall panel positioned below the wall panel and the plate rotated into a position parallel with a plate of the second wall panel, with the third resilient projection pressing against a matching projection of the second wall panel to rigidly connect the wall panel to the second wall panel when the wall panel and the second wall panel are fixed to a supporting framework.

2. The wall panel of claim 1, wherein:

the second projection is located at a rear edge of the top flange; and the second projection includes at least one aperture for connecting the wall panel to the supporting framework.

3. The wall panel of claim 1, wherein:

the wall panel is a continuous and integral piece selected from the group consisting of aluminum, stainless steel, zinc and copper.

4. The wall panel of claim 1, wherein:

the top flange, the first projection and the second projection are comprised of:

a first top horizontal sheet extending rearward from the top of the plate, a first vertical sheet extending upward from an end of the first top horizontal sheet, the first vertical sheet being folded over at a top of the first vertical sheet to form a second vertical sheet overlapping the first vertical sheet, a second top horizontal sheet extending forward from an end of the second vertical sheet and overlapping the first top horizontal sheet, and a third vertical sheet extending upward from an end of the second top horizontal sheet;

wherein the first top horizontal sheet and the second top horizontal sheet define the top flange, the third vertical sheet defines the first projection, and the first vertical sheet and the second vertical sheet define the second projection.

5. The wall panel of claim 1, further including:

a first side flange extending rearwardly from a first side of the plate; and a second side flange extending rearwardly from a second side of the plate.

6. The wall panel of claim 5, wherein:

a top width of the first side flange and the second side flange adjacent the top flange is larger than a bottom width of the first side flange and the second side flange adjacent the bottom flange, thereby allowing the plate to be vertically positioned when the wall panel overlies the second wall panel.

7. The wall panel of claim 6, wherein:

the first side flange includes a first sheet extending rearwardly from the plate, a second sheet extending outwardly from the first sheet, and a third sheet extending forwardly from the second sheet;

the first side flange defines a slot between the first sheet and the second sheet;

the second side flange includes a fourth sheet extending rearwardly from the plate, a fifth sheet extending outwardly from the fourth sheet and a sixth sheet extending rearwardly from the fifth sheet;

the sixth sheet is adapted to be accepted within a corresponding slot of a third wall panel position adjacent the second side of the plate.

8. A wall comprising:

a first panel including a first substantially rectangular plate, a top flange extending rearwardly from a top of the first substantially rectangular plate, and a first projection and second projection extending upwardly from the top flange, the first projection and the second projection defining a channel therebetween;

a second panel positioned above the first panel, the second panel including a second substantially rectangular plate, a bottom flange extending rearwardly from a bottom of the second substantially rectangular plate, and a third resilient projection extending downwardly and forwardly from the bottom flange, the third resilient projection and the bottom flange defining an acute angle therebetween; and wherein the third resilient projection of the second panel is located in the channel of the first panel and resiliently flexed between the first projection and the second projection, with the third resilient projection pressing against the first projection of the first panel to rigidly connect the second panel to the first panel when the first panel and the second panel are fixed to a supporting framework.

9. The wall of claim 8, wherein:

the second projection is located at a rear edge of the top flange; and the second projection includes at least one aperture for connecting the first panel to the supporting framework.

10. The wall of claim 8, wherein:

the first panel is a continuous and integral piece of aluminum; and the second panel is a continuous and integral piece of aluminum.

11. The wall of claim 8, wherein:

the top flange, the first projection and the second projection are comprised of:

a first top horizontal sheet extending rearward from the top of the plate, a first vertical sheet extending upward from an end of the first top horizontal sheet, the first vertical sheet being folded over at a top of the first vertical sheet to form a second vertical sheet overlapping the first vertical sheet, a second top horizontal sheet extending forward from an end of the second vertical sheet and overlapping the first top horizontal sheet, and a third vertical sheet extending upward from an end of the second top horizontal sheet;

wherein the first top horizontal sheet and the second top horizontal sheet define the top flange, the third vertical sheet defines the first projection, and the first vertical sheet and the second vertical sheet define the second projection.

12. The wall of claim 8, wherein:

the second panel includes a first side flange extending rearwardly from a first side of the second substantially rectangular plate and a second side flange extending rearwardly from a second side of the second substantially rectangular plate.

13. The wall of claim 12, wherein:

a top width of the first side flange and the second side flange adjacent the top flange is larger than a bottom width of the first side flange and the second side flange adjacent the bottom flange, thereby allowing the first substantially rectangular plate to be substantially parallel to the second substantially rectangular plate.

14. The wall of claim 13, wherein:

the first side flange includes a first sheet extending rearwardly from the second substantially rectangular plate, a second sheet extending outwardly from the first sheet, and a third sheet extending forwardly from the second sheet;

the first side flange defines a slot between the first sheet and the second sheet; and further including a third panel including a third substantially rectangular plate having a fourth sheet extending rearwardly from the third substantially rectangular plate, a fifth sheet extending outwardly from the fourth sheet and a sixth sheet extending rearwardly from the fifth sheet;

wherein the sixth sheet is adapted to be accepted within the slot of the second panel to position the third panel adjacent the second panel.

15. The wall of claim 8, further including:

a U-shaped sill located below the first panel, the sill defining a recess;

wherein the first panel includes a first panel bottom flange extending from a bottom end of the first substantially rectangular plate, the first panel bottom flange and a bottom portion of the first substantially rectangular plate being located within the recess of the U-shaped sill to retain and cover the bottom portion of the first substantially rectangular plate and the first panel bottom flange.

16. The wall of claim 8, further including:

a third panel including a third substantially rectangular plate; and a corner piece including a first recess and a second recess, the first recess and the second recess being perpendicular;

wherein a side of the first panel and a side of the second panel are located within the first recess of the corner piece and a side of the third panel is located within the second recess of the corner piece, thereby positioning the third substantially rectangular plate in a location substantially perpendicular to the first substantially rectangular plate of the first panel and the second substantially rectangular plate of the second panel.

17. The wall of claim 8, further including:

a substantially U-shaped member located above the second panel, the U-shaped member defining a recess;

wherein the second panel includes a second panel top flange extending from a top end of the second substantially rectangular plate, the second panel top flange and a top portion of the second substantially rectangular plate being located within the recess of the U-shaped member to retain and cover the top portion of the second substantially rectangular plate and the second panel top flange.

18. A wall panel comprising:

a substantially rectangular plate;

a top flange extending rearwardly from a top of the plate;

a bottom flange extending rearwardly from a bottom of the plate, the bottom flange including a downwardly extending projection;

a first side flange extending rearwardly from a first side of the plate;

a second side flange extending rearwardly from a second side of the plate;

wherein the downwardly extending projection is configured to overlay a portion of a second wall panel positioned below the wall panel; and wherein a top width of the first side flange and the second side flange adjacent the top flange is larger than a bottom width of the first side flange and the second side flange adjacent the bottom flange, thereby allowing the plate to be vertically positioned when the wall panel overlies the second wall panel.

19. The wall panel of claim 18, wherein:

the first side flange includes a first sheet extending rearwardly from the plate, a second sheet extending outwardly from the first sheet, and a third sheet extending forwardly from the second sheet;

the first side flange defines a slot between the first sheet and the second sheet;

the second side flange includes a fourth sheet extending rearwardly from the plate, a fifth sheet extending outwardly from the fourth sheet and a sixth sheet extending rearwardly from the fifth sheet;

the sixth sheet is adapted to be accepted within a corresponding slot of a third wall panel position adjacent the second side of the plate.

20. The wall panel of claim 18, further including:

a top flange extending rearwardly from a top of the plate;

a first projection and a second projection extending upwardly from the top flange, the first projection and the second projection defining a channel therebetween;

a bottom flange extending rearwardly from a bottom of the plate; and a third resilient projection extending downwardly and forwardly from the bottom flange, the third resilient projection and the bottom flange defining an acute angle therebetween;

wherein the third resilient projection is adapted to be inserted into a corresponding channel of a second wall panel positioned below the wall panel and the plate rotated into a position parallel with a plate of the second wall panel, with the third resilient projection pressing against a matching projection of the second wall panel to rigidly connect the wall panel to the second wall panel when the wall panel and the second wall panel are fixed to a supporting framework.

21. The wall panel of claim 20, wherein:

the second projection is located at a rear edge of the top flange; and the second projection includes at least one aperture for connecting the wall panel to the supporting framework.

22. The wall panel of claim 18, wherein:

the wall panel is a continuous and integral piece of aluminum.

23. The wall panel of claim 22, wherein:

the top flange, the first projection and the second projection are comprised of:

a first top horizontal sheet extending rearward from the top of the plate, a first vertical sheet extending upward from an end of the first top horizontal sheet, the first vertical sheet being folded over at a top of the first vertical sheet to form a second vertical sheet overlapping the first vertical sheet, a second top horizontal sheet extending forward from an end of the second vertical sheet and overlapping the first top horizontal sheet, and a third vertical sheet extending upward from an end of the second top horizontal sheet;

wherein the first top horizontal sheet and the second top horizontal sheet define the top flange, the third vertical sheet defines the first projection, and the first vertical sheet and the second vertical sheet define the second projection.

24. The wall panel of claim 18, wherein:

the wall panel is a continuous and integral piece of aluminum.

25. A wall comprising:

a first panel including a first substantially rectangular plate, a first panel top flange extending rearwardly from a top of the first substantially rectangular plate, a first panel bottom flange extending rearwardly from a bottom of the first substantially rectangular plate, the first panel bottom flange including a downwardly extending projection, a first panel first side flange extending rearwardly from a first side of the first substantially rectangular plate, and a first panel second side flange extending rearwardly from a second side of the first substantially rectangular plate;

a second panel positioned below the second panel, the second panel including a second substantially rectangular plate, a second panel top flange extending rearwardly from a top of the second substantially rectangular plate, the second panel top flange including an upwardly extending projection, a second panel bottom flange extending rearwardly from a bottom of the second substantially rectangular plate, a second panel first side flange extending rearwardly from a first side of the second substantially rectangular plate, and a second panel second side flange extending rearwardly from a second side of the second substantially rectangular plate;

wherein the downwardly extending projection of the first panel is configured to overlay the upwardly extending projection of the second panel; and wherein a top width of the first panel first side flange and the first panel second side flange adjacent the first panel top flange is larger than a bottom width of the first panel first side flange and the first panel second side flange adjacent the first panel bottom flange, thereby allowing the first substantially rectangular plate to be substantially parallel with the second substantially rectangular plate.

26. The wall of claim 25, wherein:

the first panel is a continuous and integral piece of aluminum; and the second panel is a continuous and integral piece of aluminum.

27. The wall of claim 25, wherein:

the second panel first side flange includes a first sheet extending rearwardly from the second substantially rectangular plate, a second sheet extending outwardly from the first sheet, and a third sheet extending forwardly from the second sheet;

the second panel first side flange defines a slot between the first sheet and the second sheet; and further including a third panel including a third substantially rectangular plate having a fourth sheet extending rearwardly from the third substantially rectangular plate, a fifth sheet extending outwardly from the fourth sheet and a sixth sheet extending rearwardly from the fifth sheet;

wherein the sixth sheet is adapted to be accepted within the slot of the second panel to position the third panel adjacent the second panel.

28. The wall of claim 25, wherein:

the first panel further includes a top flange extending rearwardly from a top of the first substantially rectangular plate, and a first projection and second projection extending upwardly from the top flange, with the first projection and the second projection defining a channel therebetween;

the second panel further includes a bottom flange extending rearwardly from a bottom of the second substantially rectangular plate and a third resilient projection extending downwardly and forwardly from the bottom flange, with the third resilient projection and the bottom flange defining an acute angle therebetween; and the third resilient projection of the second panel is located in the channel of the first panel and resiliently flexed between the first projection and the second projection, with the third resilient projection pressing against the first projection of the first panel to rigidly connect the second panel to the first panel when the first panel and the second panel are fixed to a supporting framework.

29. The wall of claim 28, wherein:

the second projection is located at a rear edge of the top flange; and the second projection includes at least one aperture for connecting the first panel to the supporting framework.

30. The wall of claim 28, wherein:

the top flange, the first projection and the second projection are comprised of:

a first top horizontal sheet extending rearward from the top of the plate, a first vertical sheet extending upward from an end of the first top horizontal sheet, the first vertical sheet being folded over at a top of the first vertical sheet to form a second vertical sheet overlapping the first vertical sheet, a second top horizontal sheet extending forward from an end of the second vertical sheet and overlapping the first top horizontal sheet, and a third vertical sheet extending upward from an end of the second top horizontal sheet;

wherein the first top horizontal sheet and the second top horizontal sheet define the top flange, the third vertical sheet defines the first projection, and the first vertical sheet and the second vertical sheet define the second projection.

31. The wall of claim 25, further including:

a U-shaped sill located below the first panel, the sill defining a recess;

wherein the first panel bottom flange and a bottom portion of the first substantially rectangular plate are located within the recess of the U-shaped sill to retain and cover the bottom portion of the first substantially rectangular plate and the first panel bottom flange.

32. The wall of claim 25, further including:

a third panel including a third substantially rectangular plate; and a corner piece including a first recess and a second recess, the first recess and the second recess being perpendicular;

wherein a side of the first panel and a side of the second panel are located within the first recess of the corner piece and a side of the third panel is located within the second recess of the corner piece, thereby positioning the third substantially rectangular plate in a location substantially perpendicular to the first substantially rectangular plate of the first panel and the second substantially rectangular plate of the second panel.

33. The wall of claim 25, further including:

a substantially U-shaped member located above the second panel, the U-shaped member defining a recess;

wherein the second panel includes a second panel top flange extending from a top end of the second substantially rectangular plate, the second panel top flange and a top portion of the second substantially rectangular plate being located within the recess of the U-shaped member to retain and cover the top portion of the second substantially rectangular plate and the second panel top flange.

34. A wall panel comprising:

a substantially rectangular plate;

a top flange extending rearwardly from a top of the plate;

a bottom flange extending rearwardly from a bottom of the plate, the bottom flange including a downwardly extending projection;

a first side flange extending rearwardly from a first side of the plate;

a second side flange extending rearwardly from a second side of the plate;

a first projection and second projection extending from a first one of the top flange and the bottom flange, with the first projection and the second projection defining a channel therebetween; and a third projection extending from a second one of the top flange and the bottom flange, with the third projection being adapted to be inserted into a corresponding channel of a second wall panel positioned below the wall panel;

wherein the wall panel is made of aluminum.

35. A wall panel comprising:

a substantially rectangular plate;

a top flange extending rearwardly from a top of the plate;

a bottom flange extending rearwardly from a bottom of the plate, the bottom flange including a downwardly extending projection;

a first side flange extending rearwardly from a first side of the plate;

a second side flange extending rearwardly from a second side of the plate;

a first resilient projection and second resilient projection extending from a first one of the top flange and the bottom flange, with the first resilient projection and the second resilient projection defining a channel therebetween; and a third resilient projection extending from a second one of the top flange and the bottom flange;

wherein the third resilient projection is adapted to be inserted into a corresponding channel of a second wall panel positioned below the wall panel and the plate rotated into a position parallel with a plate of the second wall panel, with the third resilient projection pressing against a matching projection of the second wall panel to rigidly connect the wall panel to the second wall panel when the wall panel and the second wall panel are fixed to a supporting framework.

36. The wall panel of claim 35, wherein:

the wall panel is a continuous and integral piece of aluminum.

37. A wall comprising:

a first panel including a first substantially rectangular plate, a top flange extending rearwardly from a top of the first substantially rectangular plate;

a second panel positioned above the first panel, the second panel including a second substantially rectangular plate and a bottom flange extending rearwardly from a bottom of the second substantially rectangular plate;

wherein a first resilient projection and second resilient projection extend from a first one of the top flange and the bottom flange, with the first resilient projection and the second resilient projection defining a channel therebetween;

wherein a third resilient projection extending from a second one of the top flange and the bottom flange; and wherein the third resilient projection is located in the channel and resiliently flexed between the first projection and the second projection, with the third resilient projection pressing against the first projection to rigidly connect the second panel to the first panel when the first panel and the second panel are fixed to a supporting framework.

38. The wall of claim 37, wherein:

the first panel is a continuous and integral piece of aluminum; and the second panel is a continuous and integral piece of aluminum.

* * * * *

UNITED STATES PATENT AND TRADEMARK OFFICE

CERTIFICATE OF CORRECTION

PATENT NO. : 6,694,694 B2
DATED : February 24, 2004
INVENTOR(S) : Bradley J. Zeeff It is certified that error appears in the above-identified patent and that said Letters Patent is hereby corrected as shown below:

Title page,
Item [*] Notice, delete the phrase "by 109 days" and insert -- by 186 days --

Signed and Sealed this

Twenty-second Day of March, 2005

JON W. DUDAS
*Director of the United States Patent and Trademark Office*